United States Patent [19]

Beckmann et al.

[11] Patent Number: 4,559,467

[45] Date of Patent: Dec. 17, 1985

[54] ION-GENERATOR FOR PRODUCING AN AIR FLOW

[75] Inventors: Friedrich K. Beckmann, Schenefeld; Horst Dötsch, Pinneberg; Dieter Gossel, Hamburg, all of Fed. Rep. of Germany

[73] Assignee: U.S. Philips Corporation, New York, N.Y.

[21] Appl. No.: 446,136

[22] Filed: Dec. 2, 1982

[30] Foreign Application Priority Data

Dec. 7, 1981 [DE] Fed. Rep. of Germany ..... 3148380

[51] Int. Cl.[4] ..... H05H 5/02

[52] U.S. Cl. ..... 313/359.1; 313/309; 313/351; 417/48

[58] Field of Search ..... 313/359.1, 360.1, 231.01, 313/309, 351, 581; 417/48, 49; 250/423 R, 423 F, 426; 60/202

[56] References Cited

U.S. PATENT DOCUMENTS

| | | | |
|---|---|---|---|
| 2,316,901 | 4/1943 | Thomay | 417/48 |
| 3,054,553 | 9/1962 | White | 417/48 X |
| 3,374,941 | 3/1968 | Okress | 417/48 X |
| 3,400,882 | 9/1968 | McManus | 417/48 |
| 3,751,715 | 8/1973 | Edwards | 417/48 X |

FOREIGN PATENT DOCUMENTS 1274875 5/1972 United Kingdom .

*Primary Examiner*—David K. Moore
*Assistant Examiner*—K. Wieder
*Attorney, Agent, or Firm*—Rolf E. Schneider

[57] ABSTRACT

An ion-generator for producing an air flow includes a plurality of rectangularly shaped plate electrodes spaced from one another and respectively lying in planes parallel to the direction of the air flow, such plate electrodes extending perpendicularly to the direction of the air flow, the edge of each plate electrode facing upstream being rounded. There is a plurality of rows of needle electrodes disposed upstream of the plate electrodes and extending perpendicularly to the direction of the air flow, such rows of needle electrodes being respectively associated with and oriented towards the gaps between the plate electrodes, the tips of all the needle electrodes being disposed in a plane perpendicular to the direction of the air flow. There is an electrically conductive rod-shaped support for each row of needle electrodes, such rod-shaped supports being arranged parallel to the rounded edges of the plate electrodes. An electrically insulating material covers each rod-shaped support and its associated row of needle electrodes except for the tip of each needle electrode. The plate electrodes are connected to one terminal of a high-voltage d.c. source; and the rod-shaped supports are connected to the other terminal of such d.c. source.

3 Claims, 3 Drawing Figures

ION-GENERATOR FOR PRODUCING AN AIR FLOW

Figure 1:
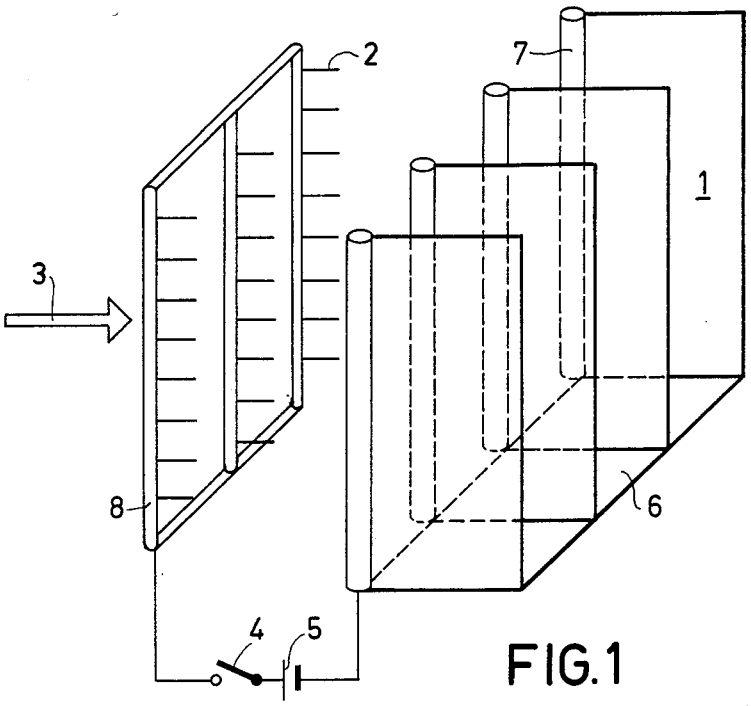

This invention relates to an ion-generator for producing an air flow, comprising a plurality of plate electrodes which are spaced from one another and lie in planes which are each parallel to the direction of the air flow, and a plurality of counter-electrodes which are disposed upstream of the plate electrodes with respect to the direction of the air flow, the plate electrodes being equipped for connection to one terminal of a high-voltage d.c. source and the counter-electrodes being equipped for connection to the other terminal of the d.c. source.

Ion-generators for producing an air flow are used in air-conditioning systems and air-cleaning systems. Published German application OS No. 2,538,958 discloses an ion-generator of the above construction which has wire-shaped counter-electrodes and plate-shaped electrodes and which produces an air flow when the plate-shaped electrodes are connected to one terminal of a high-voltage d.c. source and the wire-shaped counter-electrodes, which are disposed upstream of the plate-shaped electrodes in the direction of the air flow, are connected to the other terminal of the high-voltage d.c. source. In this known arrangement ozone is produced by electrical corona discharges at the location of the plate-shaped electrodes resulting from the angular shape of the plate-shaped electrodes which gives rise to extremely high field strengths. Ozone is a colourless, extremely toxic gas which irritates the eyes and mucous membranes and affects the respiratory system.

It is an object of the present invention to provide a construction which will minimize the extremely high field strengths produced at the location of the plate electrodes, thereby reducing the amount of ozone which is produced.

According to the invention there is provided an ion-generator for producing an air flow, comprising a plurality of plate electrodes which are spaced from one another and lie in planes which are each parallel to the direction of the air flow, and a plurality of counter-electrodes which are disposed upstream of the plate electrodes with respect to the direction of the air flow, the plate electrodes being equipped for connection to one terminal of a high-voltage d.c. source and the counter-electrodes being equipped for connection to the other terminal of the d.c. source, wherein the counter-electrodes are constructed as needle electrodes and are oriented towards the respective gaps between the plate electrodes, and wherein each plate electrode, at the edge thereof which is nearest the needle electrodes, has a cylindrical surface extending along this edge transversely of the direction of the air flow so that each plate electrode has a rounded peripheral surface facing the needle electrodes.

The provision of the rounded peripheral surface on each plate electrode ensures that the portions of these electrodes which are nearest the needle electrodes have no projecting edges where charges can become so concentrated that they act as sources of extremely high field strengths, resulting in corona discharges which not only produce ozone but are also found to affect the air flow.

In a preferred embodiment of the invention comprising three or more of said plate electrodes each having a rounded peripheral surface facing the needle electrodes, the needle electrodes are arranged in groups each disposed opposite an associated one of the gaps between the plate electrodes, the needle electrodes in each group being oriented towards the associated gap.

Preferably, the plate electrodes have a rectangular shape and are arranged in parallel planes at equal distances from each other with their rounded peripheral surfaces extending perpendicularly to the direction of the air flow, the plate electrodes being mounted on a support of planar form which lies in a plane parallel to the direction of the air flow and perpendicular to the planes of the plate electrodes. This aerodynamically favourable construction and arrangement of the plate electrodes improve the efficiency of the ion-generator in producing an air flow. Moreover, the rectangular shape and the said construction and arrangement of the plate electrodes also lead to a compact construction of the entire apparatus.

In the aforesaid preferred embodiment the electrodes of each group of needle electrodes are preferably arranged in a row extending in a direction perpendicular to the direction of the air flow, the tips of all the needle electrodes being disposed in a plane which is perpendicular to the direction of the air flow. Each row of needle electrodes may be supported on an electrically conductive rod-shaped support. This reduces the air-flow resistance and is found to be an inexpensive method of supporting the needle electrodes. Preferably, the rod-shaped supports are arranged parallel to the rounded peripheral surfaces of the plate electrode. The efficiency of the ion-generator may be improved by spacing the rod-shaped supports at the same distance from each other as the plate electrodes and locating them opposite the centres of the gaps between the plate electrodes. This results in a uniform distribution of the electrostatic field between the needle electrodes and the plate electrodes. For further reducing the formation of ozone, the rod-shaped supports may each be covered with an electrically insulating material, so that those portions of the ion-generator which carry a high voltage and consequently tend to produce ozone, but which do not contribute to the production of the air flow, are insulated.

Preferably, the distances between the tip of each needle electrode and the rounded peripheral surfaces of the plate electrodes bounding the gap towards which that needle electrode is oriented are equal and are the same for all the needle electrodes. With this arrangement an uncontrolled corona discharge at the individual needle electrodes is precluded, so that a constant air flow with a minimal production of ozone is obtained.

The needle electrodes, except for their tips, are preferably covered with an electrically insulating material. This minimizes the areas of extremely high field strengths at the location of the needle electrodes, which are necessary for the proper operation of the ion generator but which also contribute to the production of ozone.

Figure 2:
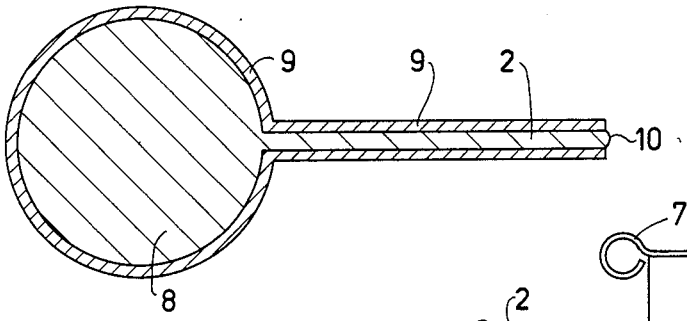
Figure 3:
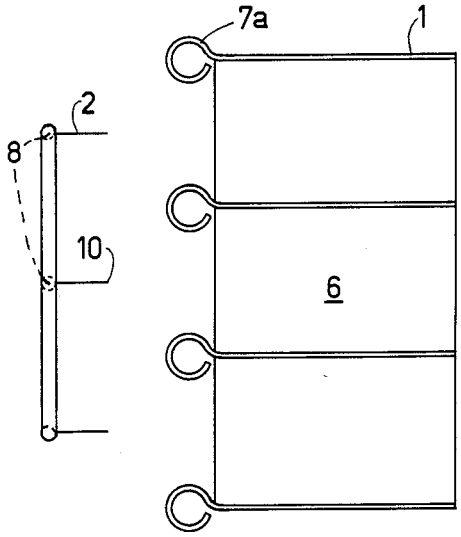

The invention will now be described in more detail with reference to the accompanying drawings, in which FIG. 1 is a diagrammatic perspective view of one embodiment of an ion generator according to the invention, FIG. 2 is an enlarged sectional view of an embodiment of a needle electrode for an ion-generator according to the invention, and FIG. 3 is a diagrammatic plan view of a second embodiment of an ion-generator according to the invention.

FIG. 1 shows an ion generator comprising plate electrodes 1 and needle electrodes 2. The needle electrodes 2 are disposed upstream of the plate electrodes 1 in the direction 3 of the air flow and are arranged in rows on rod-shaped supports 8, each electrode 2 extending in the direction of the air flow. Via a switch 4 and the supports 8, which are electrically conductive, the needle electrodes 2 can be connected to one terminal of a high-voltage d.c. source 5, the plate electrodes 1 being connected to the other terminal of the high-voltage d.c. source 5. All the plate electrodes 1 have the same size and are shaped as rectangles with short and long sides. The plate electrodes 1 are arranged in equispaced planes which are parallel to one another and to the direction of the air flow. The electrodes 1 are mounted on a support 6 of planar form which lies in a plane parallel to the direction 3 of the air flow and perpendicular to the planes of the plate electrodes, the plate electrodes being arranged so that the short edges of all the electrodes 1 are disposed parallel to the direction of the air flow in two planes which are perpendicular to the planes of the electrodes, and the long edges of all the electrodes 1 are disposed perpendicularly to the direction of the air flow in two planes which are perpendicular to this direction. Each plate electrode 1, at the upstream edge thereof, which is the edge nearest the needle electrodes 2, has a cylindrical or part-cylindrical surface 7 extending along this edge. Each plate electrode thus has a rounded peripheral surface facing the needle electrodes. Such peripheral surface can be formed by an elongate cylindrical member of electrically conductive material fixed to the respective edge of the plate electrode. All the needle electrodes 2 point in the flow direction 3 and have the same size. The electrodes in each row of needle electrodes extend parallel to one another in a plane which is parallel to and lies midway between the planes of two adjacent plate electrodes 1, so that the needle electrodes in the respective row are oriented towards the middle of the gap between these two plate electrodes. The rod-shaped supports 8 on which the needle electrodes are supported are disposed parallel to the rounded peripheral surfaces 7 of the plate electrodes 1 in a plane perpendicular to the direction of the air flow so that the tips of all the needle electrodes 2 are similarly disposed in a plane perpendicular to this direction. It is found to be advantageous if the supports 8 are spaced at the same distance from each other as the plate electrodes 1 and are located opposite the centres of the gaps between the plate electrodes. The distances between the tips of the needle electrodes 2 and the rounded peripheral surfaces 7 of the two plate electrodes 1 bounding the gap towards which those needle electrodes are oriented are then equal and are the same for all the needle electrodes.

FIG. 2 is an enlarged sectional view of one of the needle electrodes 2 and its associated support 8. This support 8 is covered completely with an electrically insulating material 9 and the needle electrode 2 is also covered with an electrically insulating material except for its tip 10. For the insulating material 9 an insulating lacquer may be used. A practical example of the above construction has rectangular plate electrodes 1 arranged at a distance of 25 mm from each other, their rounded peripheral surfaces 7 being 20 cm long. The rod-shaped supports 8 of the needle electrodes 2 are also 20 cm long and, like the plate electrodes, are arranged at a distance of 25 mm from each other. The needle electrodes 2 on each support 8 are spaced at a distance of 26 mm from each other. The needle electrodes 2 are 13 mm long and have a diameter of 50 $\mu$m. The tips 10 of the needle electrodes on each support 8 are arranged at a distance of 40 mm from the rounded peripheral surfaces 7 of the two nearest plate electrodes 1. The arrangement comprises four plate electrodes 1 and three rows of needle electrodes 2. When a d.c. voltage of 15kV is applied between the plate electrode and the needle electrodes, an air flow of 100 $m^3$ per hour is produced.

The rounded peripheral surfaces of the plate electrodes 1 shown in FIG. 3 are formed by bending a portion of each plate electrode at the upstream edge thereof into a cylindrical or part-cylindrical shape. It can be seen that the needle electrodes 2 are arranged opposite the centres of the gaps between the plate electrodes 1, and that the tips 10 of all the needle electodes 2 are spaced at the same distance from the rounded peripheral surfaces 7*a* of the two nearest plate electrodes 1 in each case. The rounded peripheral surfaces 7, 7*a* of the plate electrodes 1 may each have the shape of part or, as shown in FIG. 3, substantially the whole of a right circular cylinder. Alternatively, they may be of elliptical, pear-shaped or oval cross-section.

When the d.c. voltage is applied to the electrodes, the field between the tips 10 of the needle electrodes 2 and the plate electrodes 1 causes a positive ionization of the air molecules in the vicinity of the needle-electrode tips 10. As a result of the electrostatic field the ionized air molecules are conveyed towards the plate electrodes 1. During this drift the ions meet neutral air molecules and move these molecules in the direction of the arrow 3. If the needle electrodes 2 are connected to the negative terminal of the high-voltage d.c. source 5 the air molecules in the vicinity of the needle-electrode tips 10 are ionized negatively and subsequently they are moved in the direction 3 of the air flow by the electrostatic field between the needle electrodes 2 and the plate electrodes 1. Again the ionized air molecules collide with the neutral air molecules and move them in the direction 3.

What is claimed is:

1. An ion-generator for producing an air flow, which comprises a plurality of rectangularly shaped plate electrodes spaced from one another and respectively lying in planes parallel to the direction of the air flow, said plate electrodes extending perpendicularly to the direction of the air flow, the edge of each plate electrode facing upstream being rounded; a plurality of rows of needle electrodes disposed upstream of the plate electrodes and extending perpendicularly to the direction of the air flow, said rows of needle electrodes being respectively associated with and oriented towards the gaps between the plate electrodes, the tips of all the needle electrodes being disposed in a plane perpendicular to the direction of the air flow; an electrically conductive rod-shaped support for each row of needle electrodes, said rod-shaped supports being arranged parallel to the rounded edges of the plate electrodes; an electrically insulating material covering each rod-shaped support and its associated row of needle electrodes except for the tip of each needle electrode; means to connect the plate electrodes to one terminal of a high-voltage d.c. source; and means to connect the rod-shaped supports to the other terminal of said d.c. source.

2. An ion-generator according to claim 1, in which the plate electrodes are equally spaced from each other, and the rod-shaped supports are spaced the same distance from each other as the plate electrodes.

3. An ion-generator according to claim 2, in which the rod-shaped supports are respectively positioned opposite the centers of the associated gaps between the plate electrodes.

* * * * *